US010280058B1

(12) United States Patent
Pickett et al.

(10) Patent No.: US 10,280,058 B1
(45) Date of Patent: May 7, 2019

(54) CONTAINER TAPPING DEVICE

(71) Applicant: Cloud Candy, LLC, Calabasas, CA (US)

(72) Inventors: Peter James Pickett, Calabasas, CA (US); Tyler Mitchell Pickett, Calabasas, CA (US); Colby Joseph Pace, Calabasas, CA (US)

(73) Assignee: CLOUD CANDY, LLC, Calabasas, CA (US)

( * ) Notice: Subject to any disclaimer, the term of this patent is extended or adjusted under 35 U.S.C. 154(b) by 0 days.

(21) Appl. No.: 16/169,294

(22) Filed: Oct. 24, 2018

Related U.S. Application Data

(60) Provisional application No. 62/716,345, filed on Aug. 8, 2018.

(51) Int. Cl.
*B67B 7/00* (2006.01)
*B65D 25/48* (2006.01)

(52) U.S. Cl.
CPC ..... *B67B 7/26* (2013.01); *B65D 25/48* (2013.01); *B65D 2517/0049* (2013.01)

(58) Field of Classification Search
CPC .... B67B 7/26; B65D 25/48; B65D 2517/0049
See application file for complete search history.

(56) References Cited

U.S. PATENT DOCUMENTS 2,007,449 A * 7/1935 Kernodle ..... B67B 7/26 222/478
2,023,397 A * 12/1935 Blomgren ..... B67B 7/26 222/542
3,927,803 A * 12/1975 Weber ..... B65D 5/748 222/91
4,322,018 A * 3/1982 Rutter ..... B65D 47/263 222/105
4,712,714 A * 12/1987 Mucciarone ..... B67B 7/26 222/91
4,826,500 A * 5/1989 Rautsola ..... A61J 1/1406 222/91
5,090,596 A * 2/1992 Knight ..... B67D 3/042 222/517
5,141,134 A * 8/1992 Machado ..... A47G 23/0258 222/105
5,573,047 A * 11/1996 Akin ..... B67B 7/26 141/330

(Continued)

*Primary Examiner* — Frederick C Nicolas
(74) *Attorney, Agent, or Firm* — Cislo & Thomas, LLP

(57) ABSTRACT

A container tapping device for use with a container containing liquid contents. The device comprises a proximal end portion, a middle portion, a distal portion and a distal end portion. The proximal portion comprises a proximal surface, a distal surface, and a central bore capable of being in fluid communication with the liquid contents of the container. The middle portion comprises a locking chamber and one or more middle portion orifices, the orifice(s) capable of being in fluid communication with the central bore as well as the liquid contents of the container when the device is engaged with the container. The distal portion comprises a recess in one or more of the faces of the distal portion. The distal end portion comprises a point portion formed by an apex area of the distal portion, the point portion capable of puncturing the container and protruding therein.

17 Claims, 6 Drawing Sheets

(56) References Cited

U.S. PATENT DOCUMENTS

| | | | | | |
|---|---|---|---|---|---|
| 5,645,913 | A * | 7/1997 | Rogers | B65D 65/40 | 426/106 |
| 5,855,223 | A * | 1/1999 | Halonen | B65D 75/5877 | 137/318 |
| 5,971,207 | A * | 10/1999 | McDonough | B05B 7/1445 | 222/1 |
| 6,095,433 | A * | 8/2000 | Langdon | A01G 27/006 | 222/553 |
| 6,223,940 | B1 * | 5/2001 | Quinn | B65D 75/5877 | 222/81 |
| D480,967 | S * | 10/2003 | Lin | D9/447 | |
| 7,188,749 | B2 * | 3/2007 | Miller | B65D 11/18 | 222/1 |
| 7,503,142 | B1 * | 3/2009 | Uhl | A01M 1/04 | 141/331 |
| 9,751,678 | B2 * | 9/2017 | Macler | B65D 25/48 | |

* cited by examiner

CONTAINER TAPPING DEVICE

CROSS-REFERENCE TO RELATED APPLICATION

This patent application claims the benefit of U.S. Provisional Patent Application Ser. No. 62/716,345 entitled "Container Tapping Device" filed Aug. 8, 2018, which application is incorporated in its entirety herein by this reference.

TECHNICAL FIELD

This invention relates to devices used to tap and drink from containers and vessels.

BACKGROUND

At times, typically in a party or social gathering setting, certain persons have the desire to drink a beverage as quickly as they can. Usually this involves puncturing a beverage container (typically, a beer can, for example) with something capable of puncturing the container, and then quickly drinking the contents as they spill out. This can be dangerous and messy, as a punctured aluminum can have sharp, jagged edges that may cause injury, and the flow of the contents is not easily controllable. This makes for an undesirable situation that typically results in a mess, and may also result in injury.

Accordingly, there is a need for an improved container tapping device.

SUMMARY

The invention described herein is directed to a container tapping device for use with a container containing liquid contents. The device comprises a substantially flat proximal end portion of limited thickness, a generally cuboid-shaped middle portion, a generally square pyramidal-shaped distal portion, and a distal end portion.

The proximal end portion comprises a proximal surface oriented towards a user when the device is engaged with the container, a distal surface oriented towards the container when the device is engaged with the container, and a central bore capable of being in fluid communication with the liquid contents of the container when the device is engaged with the container, a generally cuboid-shaped middle portion having one or more non-proximal and non-distal faces, The generally cuboid-shaped middle portion further comprising a locking chamber within an internal volume of the generally cuboid-shaped middle portion, one or more middle portion orifices on one or more of the non-proximal and non-distal faces of the generally cuboid-shaped middle portion, said orifice(s) capable of being in fluid communication with the central bore as well as the liquid contents of the container when the device is engaged with the container, and one or more middle portion lips disposed between an aspect of the orifice proximate the distal surface of the proximal end portion and the distal surface of the proximal end portion itself.

The generally square pyramidal-shaped distal portion comprises one or more non-base faces, and further comprises a generally triangular pyramidal-shaped recess in one or more of the non-base faces of the generally square pyramidal-shaped distal portion.

The distal end portion comprises a point portion formed by an apex area of the generally square pyramidal-shaped distal portion, said point portion capable of puncturing the container and protruding therein when sufficient force is applied to the device by a user.

In an alternate embodiment, the present invention comprises a container tapping device for use with a container containing liquid contents, the device comprising a substantially flat proximal end portion, a middle portion, a distal portion, and a distal end portion.

The proximal end portion comprises a proximal surface oriented towards a user when the device is engaged with the container, a distal surface oriented towards the container when the device is engaged with the container, and, a central bore capable of being in fluid communication with the liquid contents of the container when the device is engaged with the container.

The middle portion comprises a locking chamber within an internal volume of the middle portion, and one or more middle portion orifices on one or more faces of the middle portion, said orifice(s) capable of being in fluid communication with the central bore as well as the liquid contents of the container when the device is engaged with the container.

The distal portion has one or more faces, the distal portion further comprising a recess in one or more of the faces of the distal portion.

The distal end portion comprises a point portion formed by an apex area of the distal portion, said point portion capable of puncturing the container and protruding therein when sufficient force is applied to the device by a user.

Optionally, the middle portion may be generally cylindrical.

Optionally, device may be formed from a single, unitary piece of material.

Optionally, the proximal end portion, the middle portion and the distal portion may be separate structures that couple together utilizing a snap fit or friction fit.

Optionally, the device further comprises a gasket disposed around an outer surface of the middle portion, proximate the distal surface of the proximal end portion.

Optionally, the device comprises at least one vent disposed in the proximal end portion.

Optionally, the device further comprises a cover, the cover having a cavity into which the middle portion and distal portion of the device are inserted and retained therein by friction.

Optionally, the cover further comprises an attachment mechanism for coupling the cover to a key chain. Optionally, the attachment mechanism comprises a loop of material or a clip.

Optionally, the orifices may be generally circular, generally square-shaped, or generally arch-shaped.

Optionally, the device further comprises one or more middle portion lips disposed between an aspect of the orifice proximate the distal surface of the proximal end portion and the distal surface of the proximal end portion itself.

The present invention, in the context of its intended use, comprises a method of using a container tapping device, the method comprising the steps of: a) providing the container tapping device; b) providing a container containing liquid contents maintained under pressure; c) grasping the container in one hand; d) grasping the device in an other hand; e) puncturing the container with the point portion of the distal end portion and inserting the distal end portion, the distal portion, and the middle portion of the device into the container until the distal surface of the proximal portion is flush with a side wall of the container; and f) drinking the liquid contents of the container through the device.

DETAILED DESCRIPTION OF THE INVENTION

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

Figure 1:
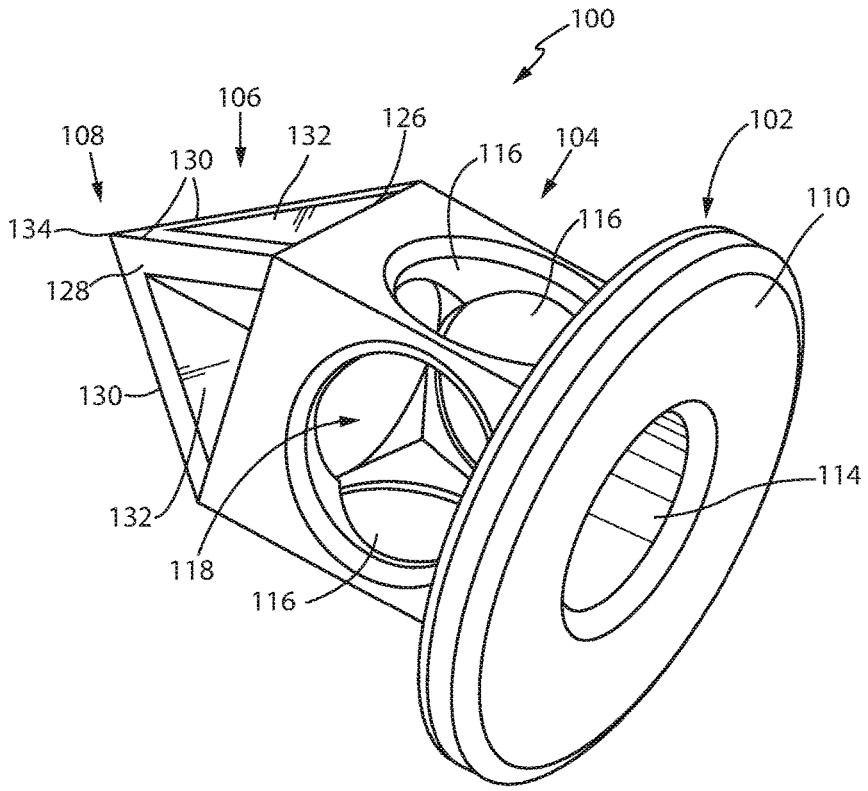
FIG. 1 a perspective view of a container tapping device.
Figure 2:
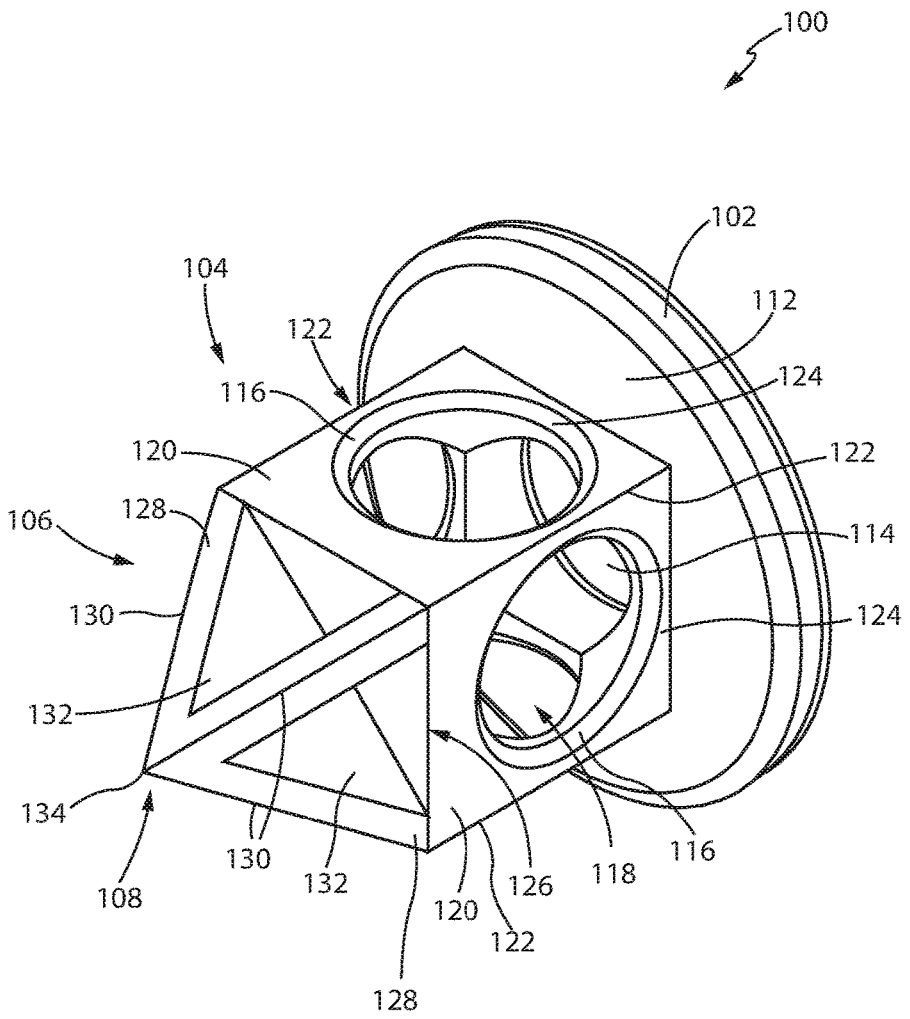
FIG. 2 is an additional perspective view of the container tapping device of FIG. 1.
Figure 3:
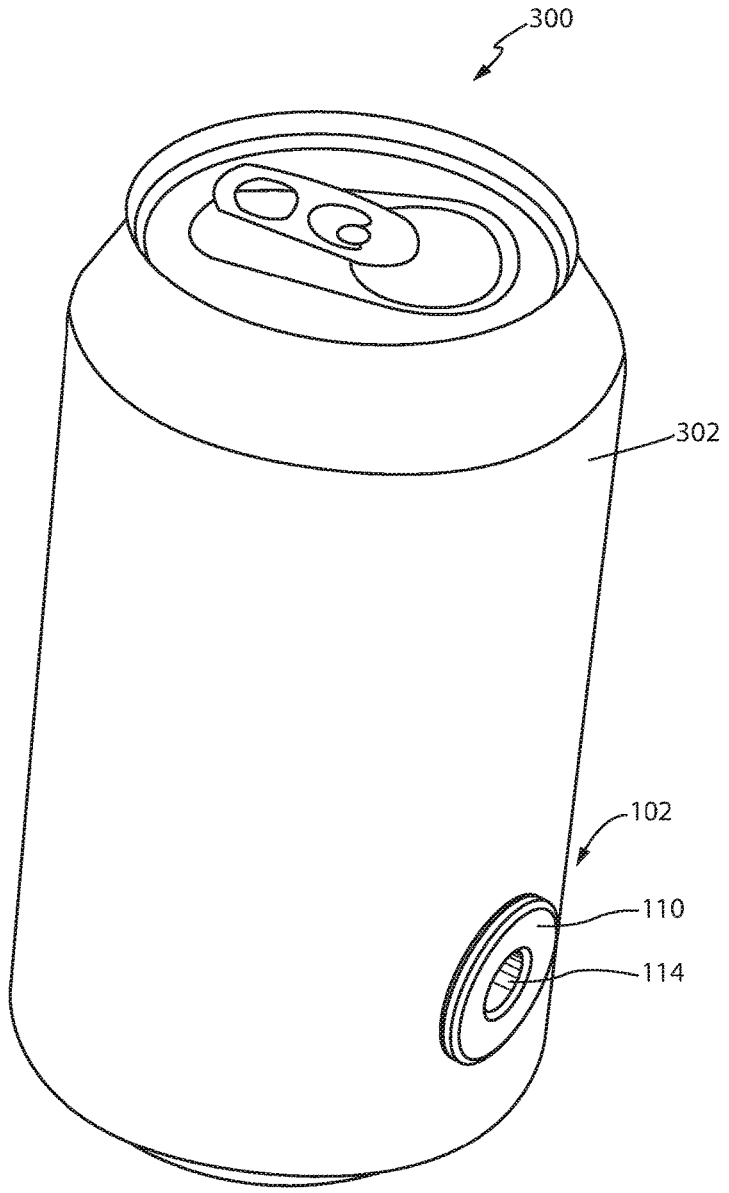
FIG. 3 is a perspective view of the container tapping device of FIG. 1, wherein the container tapping device has been inserted into a container.

Referring now to FIGS. 1-3, there is shown a container tapping device 100 for use with a container 300 containing liquid contents. The liquid contents may be under pressure, such as in a soda or beer can. The container tapping device 100 comprises a proximal end portion 102, a middle portion 104, a distal portion 106, and a distal end portion 108.

The proximal end portion 102 is substantially flat and comprises a limited thickness. The proximal end portion 102 can be any shape, including, but not limited to, a circle, square, oval, rectangle or triangle shape. Preferably, the proximal end portion 102 is circular and has a diameter that is greater than its thickness.

The proximal end portion 102 comprises a proximal surface 110 oriented towards a user when the device 100 is engaged with the container 300, a distal surface 112 oriented towards the container 300 when the device 100 is engaged with the container 300, and a central bore 114 capable of being in fluid communication with the liquid contents of the container 300 when the device 100 is engaged with the container 300. In use, the user places their lips against proximal surface 110 of the proximal end portion 102 of the device, and then drinks the liquid contents of the container 300 through the central bore 114 (or, perhaps more particularly, the user receives in his or her gullet the liquid contents of container 300 through central bore 114 and into the user's gullet with more force than simple gravity as would be applicable if the user simply tilted the container to drink from it.

The middle portion 104 can be any shape, including but not limited to cuboid-shaped or cylindrical-shaped, but preferably, the middle portion 104 is generally cuboid-shaped. The middle portion 104 comprises one or more middle portion orifices 116 and a locking chamber 118.

If the middle portion 104 is generally cuboid-shaped, the one or more middle portion orifices 116 are disposed on one or more of the non-proximal and non-distal faces 120 of the middle portion 104. If the middle portion 104 is cylindrical in shape, the one or more orifices 116 are spaced around the cylinder. The orifices 116 are capable of being in fluid communication with the central bore 114 as well as the liquid contents of the container 300 when the device 100 is engaged with the container 300. The orifices 116 can be any shape, including, but not limited to, circular, square-shaped, or arch-shaped. Preferably the orifices 116 are circular.

The locking chamber 118 is the space within an internal volume of the middle portion 104. Based on its configuration, the locking chamber 118 facilitates retention of the device 100 within the container 300 and helps prevent leakage. If the middle portion 104 is generally cuboid-shaped, then the locking chamber 118 is also generally cuboid-shaped. In this configuration, the middle portion 104 comprises four external corners 122, and when the distal portion 106 and distal end portion 108 puncture a side wall 302 of the container 300, which is typically an aluminum can, the aluminum tends to tear (or be pierced) in four locations, creating a generally square-shaped hole that is in general alignment with the four external corners 122 of the middle portion 104. As the distal portion 106 and distal end portion 108 are inserted further into the container 300, the torn aluminum side wall 302 folds inward. The folding of the aluminum side wall 302 inward is advantageous because it prevents the user from being cut by sharp, jagged, protruding aluminum edges when the user drinks from the device 100. Additionally, because of the presence of the orifices 116 in the middle portion 104, the inwardly folded aluminum side wall 302 may engage with the orifices 116, helping to lock the device 100 in place within the container 300.

Figure 5:
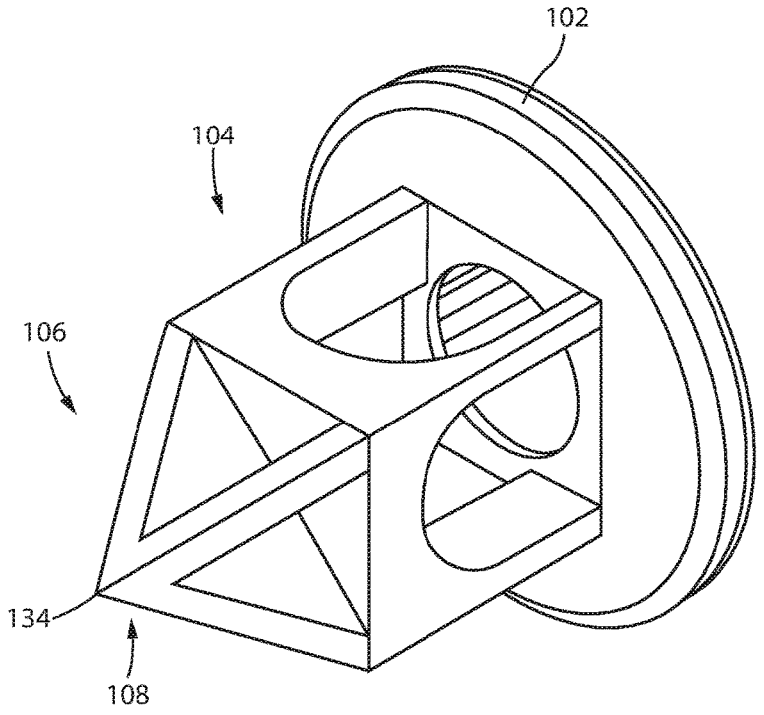
FIG. 5 is a perspective view of an additional embodiment of a container tapping device, wherein orifices are arch-shaped.

Optionally, as best seen in FIG. 2, the middle portion 104 comprises one or more middle portion lips 124 disposed between an aspect of the orifice 116 proximate the distal surface 112 of the proximal end portion 102 and the distal surface 112 of the proximal end portion 102 itself. The lips 124 are advantageous because they help prevent leakage. The liquid contents only exit the device 100 via the central bore 114, rather than spilling out around the edges of the proximal end portion 102. Optionally, as shown in FIG. 5, the middle portion 104 may not comprise lips 124.

Preferably the distal portion 106 a generally square pyramidal-shaped distal portion having a base 126 and one or more non-base faces 128. Base 126 of the distal portion 106 is configured to mate substantially flush with the middle portion 104. Where sides of the non-base faces 128 join each other, the faces 128 taper together and form edges or vertices 130 that facilitate puncturing of the container 300. Preferably, the edges 130 are fine or sharp so as to facilitate puncturing of the container 300.

Optionally, the generally square pyramidal-shaped distal portion 106 can further comprise a recess 132 in one or more of the non-base faces 128 of the generally square pyramidal-shaped distal portion 106. Less preferably, the distal portion 106 can be generally triangular pyramidal-shaped.

The distal end portion 108 comprises a point portion 134 formed by an apex area of the distal portion 106, and the point portion 134 is capable of puncturing the container 300 and protruding therein when sufficient force is applied to the device 100 by a user.

The device 100 can either be a unitary design or multi-unit assembly. If the device 100 is a unitary design, it may be uniformly molded or machined from a single piece of material. Optionally, the device 100 may be 3D printed. If the device 100 is a multi-unit assembly, the proximal end portion 102, the middle portion 104 and the distal portion 106 may be separate structures that couple together utilizing a snap or friction fit.

The entire device 100 can be made from the same material, which is typically a rigid plastic or relatively hard metal (or metal capable of being hardened). Alternatively, just the distal portion 106 and distal end portion 108 can be made from a rigid material so as to facilitate puncturing the container 300, and the proximal portion 102 can be made from or covered in a softer or conformable material such as rubber.

Optionally, the device 100 may further comprise a gasket (not shown) disposed around an outer surface of the middle portion 104, proximate and generally flush with the distal surface 112 of the proximal end portion 102. The gasket can be made of rubber or other conformable material and can be used to enhance sealing between the container 300 and the proximal end portion 102 of the device 100.

Figure 4:
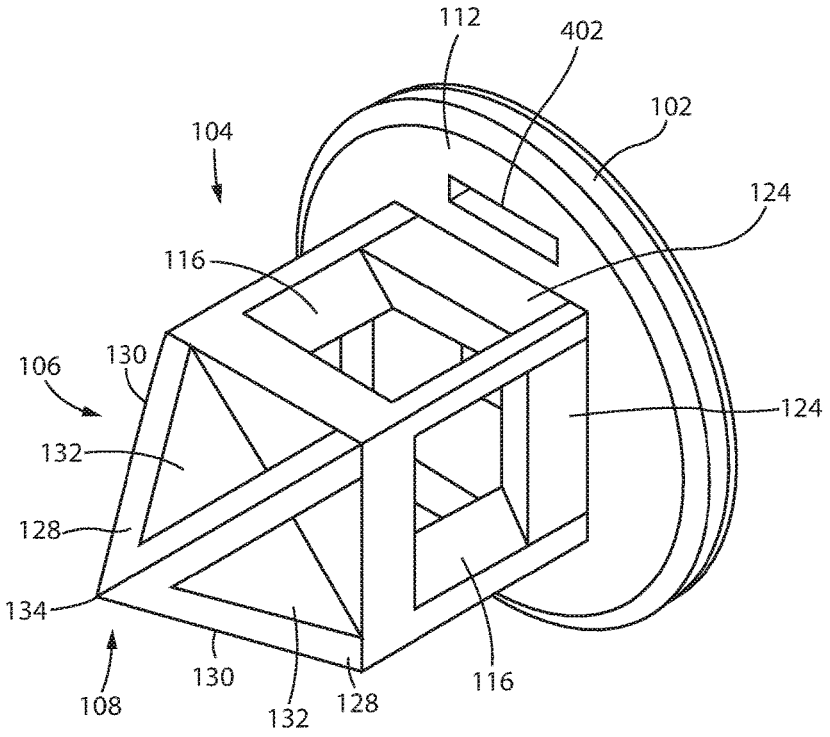
FIG. 4 is a perspective view of an additional embodiment of a container tapping device, wherein orifices are square-shaped.

Optionally, as shown in FIG. 4, the device 100 can further comprise at least one vent 402 disposed in the proximal end portion 102. The vent 402 is formed in proximal end portion 102 and allows air to pass from the central bore 114 into the container 300 and allows fluid to pass from the container 300 into the locking chamber 118, into the central bore 114, and then into the mouth of the user.

Figure 6:
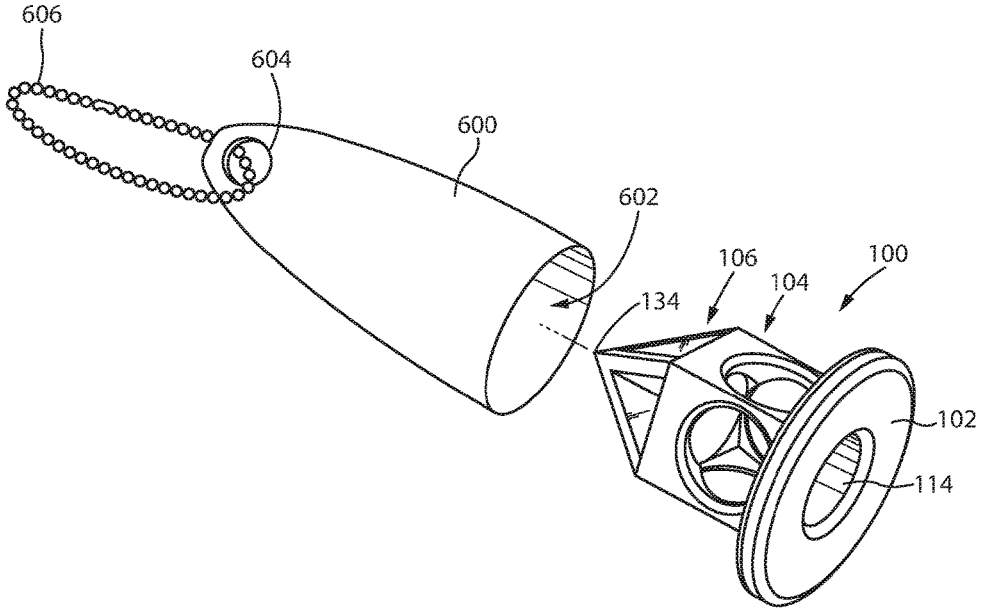
FIG. 6 is a perspective view of the container tapping device of FIG. 1 shown with a cover.

Optionally, as shown in FIG. 6, the device 100 can further comprise a cover 600. One of the advantages of the device 100 is that it functions as a personal mouthpiece for drinking from containers 300. This provides the user with the peace of mind that the surface they are placing their mouth upon is used by that user alone. The cover 600 has a cavity 602 into which the middle portion 104, distal portion 106, and distal end portion 108 of the device 100 are inserted and retained therein by friction. The cover 600 can be made from either a semi-rigid or flexible material. The diameter of the cavity 602 of the cover 600 is sized such that the device 100 can be held in place therein through friction. Other retaining means or mechanisms may be incorporated, such as elastic, spring-biased tabs or latches. The cover 600 can further comprise an eyelet 604 and a length of material 606, such as a chain or rope, for attachment of the cover 600 to a key fob or the like.

The present invention is directed to a method of using a container tapping device 100. The method comprises the steps of: a) providing the container tapping device 100; b) providing a container 300 containing liquid contents maintained under pressure; c) grasping the container 300 in one hand; d) grasping the device 100 in an other hand; e) puncturing the container 300 with the pointed portion 134 of the distal end portion 108 and inserting the distal end portion 108, the distal portion 106 and the middle portion 104 of the device 100 into the container 300 until the distal surface 112 of the proximal end portion 102 is flush with a side wall 302 of the container 300; and, f) drinking the liquid contents of the container 300 through the device 100.

The dimensions of the device 100 described herein in its various configurations are intended to be generally consistent with how the device is shown and described herein; although, no particular dimensions are required, other than generally how the device is shown and described herein in order for the device to be capable of performing its function (s).

The foregoing description of the preferred embodiment(s) of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

What is claimed is:

1. A container tapping device for use with a container containing liquid contents, the device comprising:

a. a substantially flat proximal end portion of limited thickness comprising:
   i. a proximal surface oriented towards a user when the device is engaged with the container;
   ii. a distal surface oriented towards the container when the device is engaged with the container; and
   iii. a central bore capable of being in fluid communication with the liquid contents of the container when the device is engaged with the container;

b. a substantially cuboid-shaped middle portion having one or more non-proximal and non-distal faces, the substantially cuboid-shaped middle portion further comprising:
   i. a locking chamber within an internal volume of the substantially cuboid-shaped middle portion;
   ii. one or more middle portion orifices on one or more of the non-proximal and non-distal faces of the substantially cuboid-shaped middle portion, said orifice(s) capable of being in fluid communication with the central bore as well as the liquid contents of the container when the device is engaged with the container; and
   iii. one or more middle portion lips disposed between an aspect of the orifice proximate the distal surface of the proximal end portion and the distal surface of the proximal end portion itself;

c. a substantially square pyramidal-shaped distal portion having one or more non-base faces, the substantially square pyramidal-shaped distal portion further comprising a substantially triangular pyramidal-shaped recess in one or more of the non-base faces of the substantially square pyramidal-shaped distal portion; and d. a distal end portion comprising a point portion formed by an apex area of the substantially square pyramidal-shaped distal portion, said point portion capable of puncturing the container and protruding therein when sufficient force is applied to the device by a user.

2. The container tapping device of claim 1, wherein the device is formed from a single, unitary piece of material.

3. The container tapping device of claim 1, wherein the proximal end portion, the middle portion and the distal portion are separate structures that couple together utilizing a snap fit.

4. The container tapping device of claim 1, further comprising a gasket disposed around an outer surface of the middle portion, proximate the distal surface of the proximal end portion.

5. The container tapping device of claim 1, further comprising at least one vent disposed in the proximal end portion.

6. The container tapping device of claim 1, further comprising a cover, the cover having a cavity into which the middle portion and distal portion of the device are inserted and retained therein by friction.

7. The container tapping device of claim 1, wherein the orifices are circular.

8. The container tapping device of claim 1, wherein the orifices are square-shaped.

9. The container tapping device of claim 1, wherein the orifices are arch-shaped.

10. A container tapping device for use with a container containing liquid contents, the device comprising:

a. a substantially flat proximal end portion comprising:
   i. a proximal surface oriented towards a user when the device is engaged with the container;
   ii. a distal surface oriented towards the container when the device is engaged with the container; and,
   iii. a central bore capable of being in fluid communication with the liquid contents of the container when the device is engaged with the container;

b. a middle portion further comprising:
   i. a locking chamber within an internal volume of the middle portion;
   ii. one or more middle portion orifices on one or more faces of the middle portion, said orifice(s) capable of being in fluid communication with the central bore as well as the liquid contents of the container when the device is engaged with the container; and
   iii. one or more middle portion lips disposed between an aspect of the orifice proximate the distal surface of the proximal end portion and the distal surface of the proximal end portion itself;

c. a distal portion having one or more faces, the distal portion further comprising a recess in one or more of the faces of the distal portion; and d. a distal end portion comprising a point portion formed by an apex area of the distal portion, said point portion capable of puncturing the container and protruding therein when sufficient force is applied to the device by a user.

11. The container tapping device of claim 10, wherein the middle portion is cylindrical.

12. The container tapping device of claim 10, wherein the orifices are square-shaped.

13. The container tapping device of claim 10, wherein the orifices are arch-shaped.

14. The container tapping device of claim 10, further comprising a cover, the cover having a cavity into which the middle portion and distal portion of the device are inserted and retained therein by friction.

15. The container tapping device of claim 14, wherein the cover further comprises an attachment mechanism for coupling the cover to a key chain.

16. The container tapping device of claim 15, wherein the attachment mechanism comprises a loop of material or a clip.

17. A method of using the container tapping device of claim 10, the method comprising the steps of:

a) providing the container tapping device;
b) providing the container containing the liquid contents maintained under pressure;
c) grasping the container in one hand;
d) grasping the device in an other hand;
e) puncturing the container with the point portion of the distal end portion and inserting the distal end portion, the distal portion, and the middle portion of the device into the container until the distal surface of the proximal portion is flush with a side wall of the container; and
f) drinking the liquid contents of the container through the device.

* * * * *